US005653672A

United States Patent [19]

Niinai et al.

[11] Patent Number: 5,653,672

[45] Date of Patent: Aug. 5, 1997

[54] CENTRIFUGAL SEPARATOR WITH THERMO-MODULE

[75] Inventors: Yoshitaka Niinai; Hiroshi Hayasaka, both of Hitachinaka, Japan

[73] Assignee: Hitachi Koki Co., Ltd., Japan

[21] Appl. No.: 654,200

[22] Filed: May 28, 1996

[30] Foreign Application Priority Data

Jun. 28, 1995 [JP] Japan ..... 7-162300

[51] Int. Cl.[6] ..... B04B 15/02

[52] U.S. Cl. ..... 494/14; 62/3.6

[58] Field of Search ..... 494/10, 13, 14, 494/16, 60, 85; 366/144–146; 210/178, 179, 186; 62/3.6

[56] References Cited

U.S. PATENT DOCUMENTS 4,512,758 4/1985 Wedemeyer et al. ..... 62/3.6 X 4,690,669 9/1987 Williams et al. ..... 494/14

4,785,637 11/1988 Giebeler ..... 494/14 X 4,941,866 7/1990 Gorodissky et al. ..... 494/14

*Primary Examiner*—Charles E. Cooley

*Attorney, Agent, or Firm*—Rossi & Associates

[57] ABSTRACT

A centrifugal separator comprises a rotor 5 capable of accommodating a test sample therein, a cooling container 2 accommodating rotor 5 therein, a thermo-module 7 interposed between cooling container 2 and a radiator 3, and a coil spring 8 interposed between cooling container 2 and radiator 3. By the resilient force acting upward, cooling container 2 is lifted or floated off thermo-module 7 when cooling container 2 is placed on thermo-module 7.

6 Claims, 3 Drawing Sheets

CENTRIFUGAL SEPARATOR WITH THERMO-MODULE

BACKGROUND OF THE INVENTION

1. Field of the Invention

The present invention generally relates to rotary devices, such as centrifugal separators, which are normally required to maintain their temperatures at predetermined values, and more particularly to a unique arrangement for supporting a heart exchangeable container used in such rotary devices.

2. Prior Art

Centrifugal separators, used in the fields of medical science or agricultural science, are generally equipped with adequate cooling devices for maintaining the temperature of test samples at designated temperatures.

One of such cooling devices is a thermo-module utilizing Peltier effect. For example, Unexamined Japanese Patent Application (Tokuhyo) No. SHO 61-502016 or Unexamined Japanese Patent Application (Kokai) No. HEI 4-277048 discloses a cooling device comprising a thermo-module disposed on a radiator (heat sink) and a container mounted on the thermo-module. The temperature of the container is maintained at a constant value by varying the flow direction of an electric current supplied to the thermo-module.

In such an arrangement of a cooling device, a contact surface between the radiator and the thermo-module, or a contact surface between the thermo-module and the container, is not so flush as an ideal plane. This is why heat-conductive grease is normally applied on the contact surface to increase the transfer of heat. However, if any dislocation is caused in the process of successively mounting the thermo-module and the container on the radiator, it is definitely necessary to adjust the position of the container to a correct position. In such an adjustment, there is a possibility that the heat-conductive grease is undesirably spread out in accordance with the slide movement of the container, resulting in the lack of heat-conductive grease within the area of the contact surface.

This will be explained in greater detail with reference to FIGS. 5 and 8. A plurality of thermo-modules 7, after being applied heat-conductive grease on the bottom thereof, are placed on an upper surface of radiator 3. A plurality of ball-pieces 12 are mounted on thermo-modules 7 and are fixed by means of screws.

Then, heat-conductive grease is applied on the upper surface of each ball-piece 12. A cooling container 2 is placed on the ball-pieces 12 through heat-conductive grease and is fixed by means of screws *9b*.

However, in the mounting operation of cooling container 2 on ball-pieces 12, ball-pieces 12 are virtually concealed by the bulky bottom of cooling container 2. Hence, for an operator, it is very difficult to check the position of each ball-piece 12. Accordingly, as shown in FIG. 8, it is usual that the axial center of screw hole 14 opened in ball-piece 12 is undesirably offset from the center of a hole 15 opened on the bottom of cooling container 2 when the cooling container 2 is placed ball-piece 12.

The operator is, therefore, forced to adjust the position of cooling container 2 with respect to ball-piece 12 by sliding cooling container 2 in a direction shown by an arrow. Such an sliding adjustment of cooling container 2 possibly causes undesirable spreading of heat-conductive grease out of the contact surface between cooling container 2 and each ball-piece 12, resulting in the serious lack of heat-conductive grease within the area of the contact surface.

SUMMARY OF THE INVENTION

Accordingly, in view of above-described problems encountered in the prior art, a principal object of the present invention is to provide a novel and excellent cooling device capable of preventing heat-conductive grease from spreading out of the predetermined contact surface in the mounting operation of the cooling container unless the cooling container is fastened to a predetermined position by a screw or the like, and therefore surely increasing the heat transfer ability as well as enhancing the reliability.

In order to accomplish this and other related objects, the present invention provides a centrifugal separator comprising a rotor capable of accommodating a test sample therein, a cooling container accommodating the rotor therein, a thermo-module interposed between the cooling container and a radiator, and an elastic member interposed between the cooling container and the radiator so that the cooling container is lifted or floated off the thermo-module when the cooling container is placed on the thermo-module.

According to the features of preferred embodiments of the present invention, the elastic member is a coil spring. The elastic member is made of stainless steel or plastic.

Furthermore, a ball-piece is provided on an upper surface of the thermo-module, the ball-piece is fixed to the radiator by means of a screw so as to sandwich the thermo-module between the radiator and the ball-piece, and at least one elastic member is interposed between the cooling container and the ball-piece so that the cooling container is lifted or floated off the ball-piece with a clearance when the cooling container is placed on the ball-piece. The cooling container and the ball-piece are fastened together by a screw so that the clearance is reduced.

The arrangement of interposing the elastic member between the radiator and the cooling container is effective to separate the cooling container off the thermo-module or the ball-piece with a sufficient clearance therebetween. The clearance thus provided between the cooling container and the thermo-module or the ball-piece can be eliminated by fastening a screw or an appropriate fastening member against the resilient force of the elastic member, thereby surely providing an effective and sufficient contact surface.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
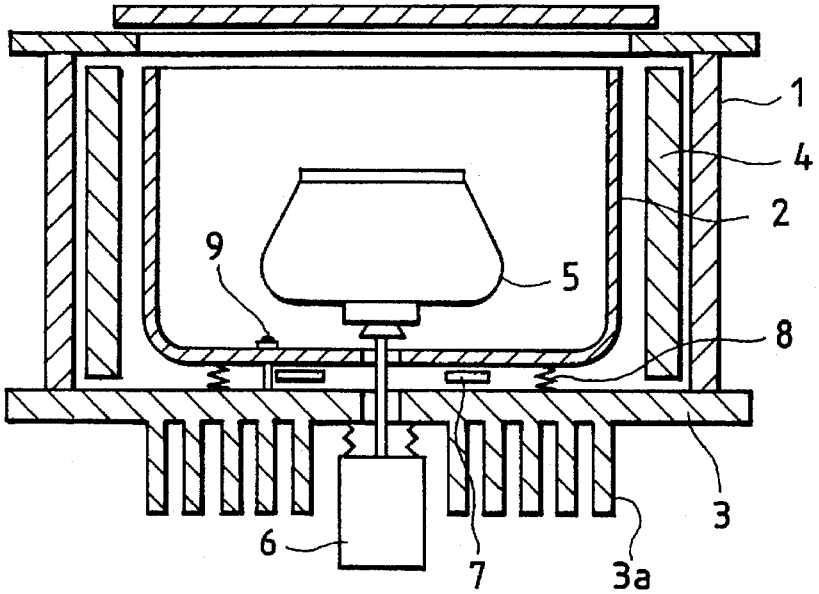
FIG. 1 is a cross-sectional view showing an arrangement of a cooling container support structure for a centrifugal separator in accordance with a preferred embodiment of the present invention.

Preferred embodiments of the present invention will be explained in greater detail hereinafter, with reference to FIGS. 1 through 4. Identical parts are denoted by identical reference numerals throughout views.

Figure 2:
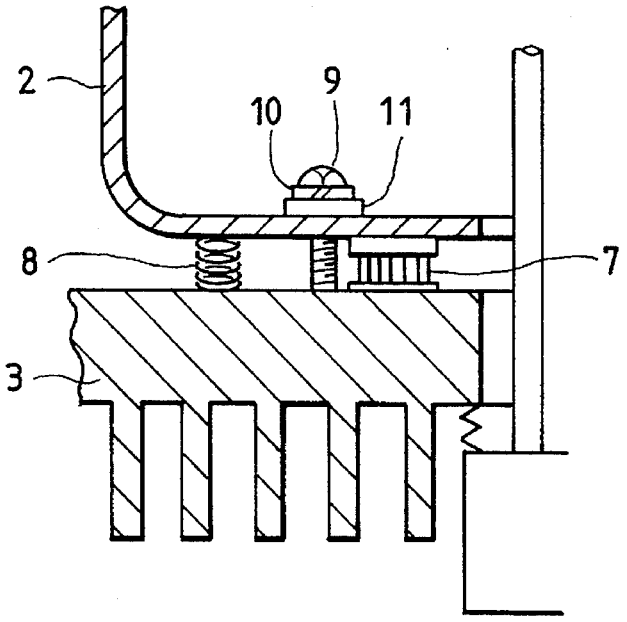
FIG. 2 is an enlarged cross-sectional view showing the details of the cooling container support structure shown in FIG. 1.

In FIGS. 1 and 2, a rotor 5, having a test sample (not shown) therein, is rotated at a high speed by a driving device 6 in a chamber 1. A radiator 3, with radiation fins 3*a*, is provided under chamber 1. A plurality of thermo-modules 7 are provided on radiator 3. A cooling container 2 is mounted on thermo-modules 7 and is fixed by means of screws 9. A temperature sensor (not shown), provided inside chamber 1, detects the temperature of rotor 5 to feedback control an electric current supplied to each thermo-module 7 to maintain the temperature of cooling container 2 at a designated value.

Heat conductive grease, such as silicone grease, is applied on a contact surface between radiator 3 and each thermo-module 7 and also applied on a contact surface between each thermo-module 7 and cooling container 2, to reduce thermal resistance and smooth the transfer of heat.

A plurality of coil springs 8 are interposed, in a compressed condition, between radiator 3 and cooling container 2. Receiving a resilient force from these coil springs 8, cooling container 2 is lifted off thermo-modules 7 with a significant clearance before cooling container 2 is fastened by screws 9.

In the assembling of the apparatus having the arrangement described above, heat-conductive grease is first applied on the upper and lower contact surfaces of thermo-modules 7. Then, thermo-modules 7 are placed on radiator 3. Thereafter, cooling container 2 is placed on thermo-modules 7.

In this condition, cooling container 2 is lifted or floated above thermo-modules 7 by the function of coil springs 8 as above-described. A clearance, kept between thermo-modules 7 and cooling container 2 by the intervention of coil springs 8, is wide enough to allow an operator to visually check the position of a screw hole into which each screw 9 is engaged, facilitating the fixing operation of cooling container 2 on thermo-modules 7. In other words, this arrangement makes it possible to prevent heat-conductive grease from spreading undesirably along the bottom surface of cooling container 2 or the upper surface of radiator 3.

Figure 3:
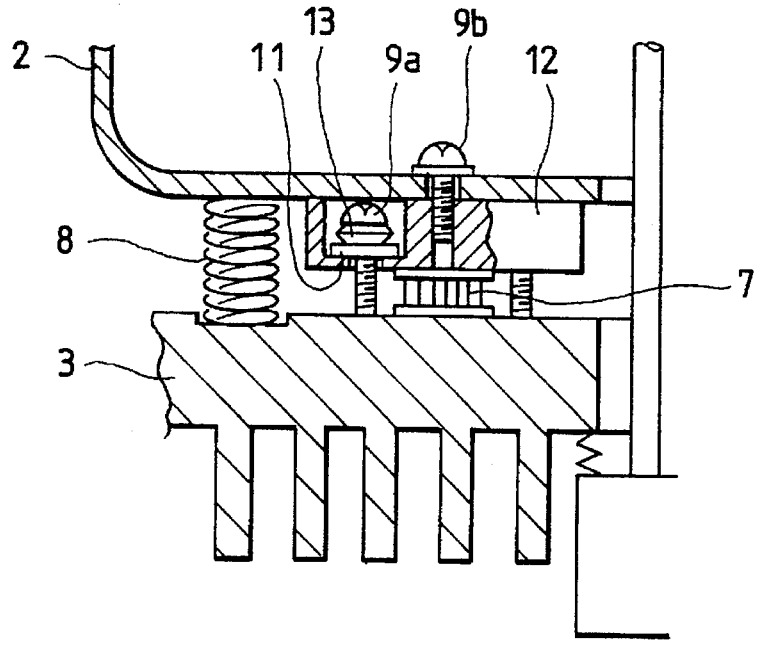
FIG. 3 is an enlarged cross-sectional view showing an arrangement of a cooling container support structure in accordance with another embodiment of the present invention.
Figure 4:
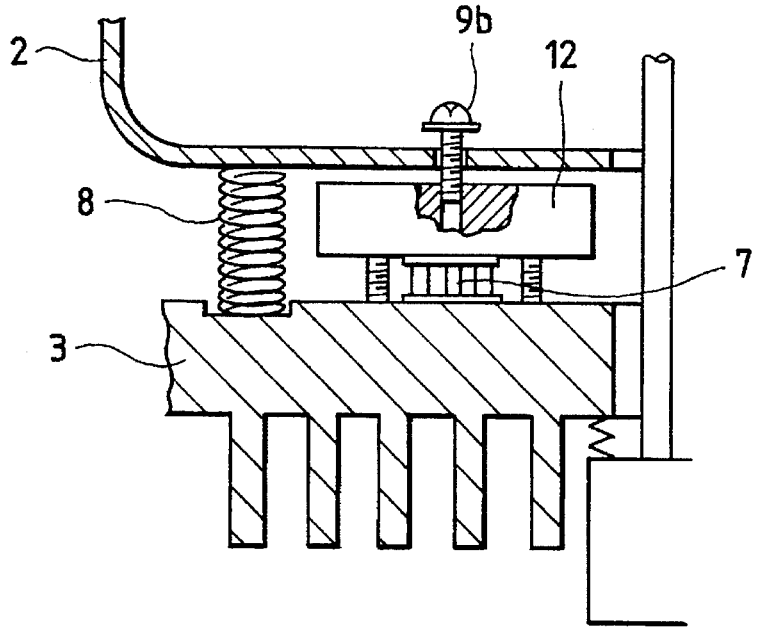
FIG. 4 is an enlarged cross-sectional view showing a condition where a cooling container shown in FIG. 3 is not fixed.
Figure 5:
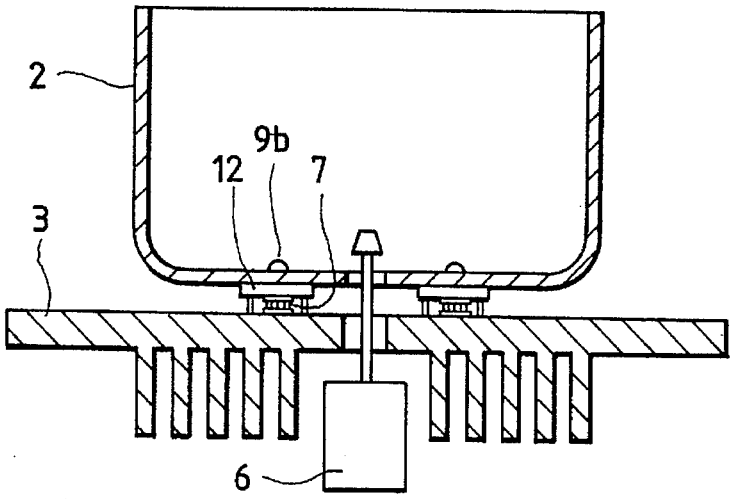
FIG. 5 PRIOR ART
FIG. 5 is a cross-sectional view showing an arrangement of a conventional centrifugal separator.
Figure 6:
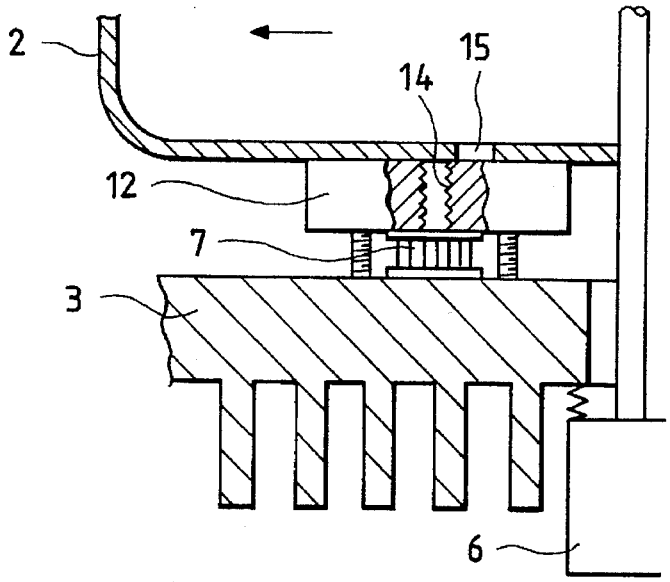
FIG. 6 PRIOR ART
FIG. 6 is an enlarged cross-sectional view showing a condition where a cooling container shown in FIG. 5 is mounted on a ball-piece.

This will be further explained in greater detail on another embodiment of the present invention with reference to FIGS. 3 and 4.

Each thermo-module 7, after being applied heat-conductive grease on its contact surface, is placed on radiator 3. Then, a ball-piece 12 is placed on a corresponding thermo-module 7 and is fixed by means of a screw 9*a*. A heat-insulating washer 11 and a disc spring 13 are coupled with screw 9*a* between an installation plane of ball-piece 12 and the head of screw 9*a*. Heat-insulating washer 11 acts as a means for preventing heat from leaking, while disc spring 13 acts as a means for correcting a thermal deformation as disclosed in more detail in Unexamined Japanese Patent Application (Kokai) No. SHO 53-15660, published in 1978.

When cooling container 2 has a lower rigidity, cooling container 2 may be deformed when fastened by screws 9 as shown in FIG. 2, causing a local damage to the contact surface (i.e. reduction or loss of an effective contact area). Using ball-piece 12 is intended to prevent such a deformation of cooling container 2 leading to the unacceptable damage of contact surfaces.

Subsequently, heat-conductive grease is applied on the upper surface of ball-piece 12. Cooling container 2 is placed on ball-piece 12 and is then fastened by means of a screw 9*b*.

In this condition, cooling container 2 is lifted or floated above ball-piece 12 by the function of coil spring 8 as shown in FIG. 4. A clearance, kept between ball-piece 12 and cooling container 2 by the intervention of coil springs 8, is wide enough to allow an operator to visually check the position of a screw hole into which each screw 9*b* is engaged, facilitating the fixing operation of cooling container 2 on ball-piece 12 even if cooling container 2 is dislocated with respect to the screw hole on ball-piece 12. In other words, this arrangement makes it possible to prevent heat-conductive grease from spreading out undesirably along the bottom surface of cooling container 2.

The resilient force of coil spring 8 is set to a value sufficient to support cooling container 2 at a floating condition maintaining an adequate clearance between cooling container 2 and ball-piece 12. An axial tension of screw 9*b* gives a sufficient contact pressure between cooling container 2 and ball-piece 12 against the resilient force of coil spring 8. Coil spring 8 is preferably a stainless or plastic product, which is a material having a low heat conductivity, in view of prevention of heat transfer from the high-temperature side to the low-temperature side.

In addition, washers of screws 9 and 9*a*, used for fixing cooling container 2, are preferably made of plastic or other low-heat-conductive material. Adopting such washers is effective to prevent cooling container 2 from being brought into direct contact with a metallic member. Thus, it becomes possible to suppress the undesirable transfer of heat to cooling container 2 as less as possible.

However, throughout the operations to be performed, there is a possibility that the operator may accidentally or intentionally touch the cooling container 2 when the operator handles the rotor 5 placed in the cooling container 2.

In such a case, cooling container 2, which is electrically insulated, will receive a significant amount of electrical charge when touched by the operator.

However, the arrangement of the present invention can eliminate such undesirable charging phenomenon due to provision of coil spring 8 because coil spring 8 is electrically connected to cooling container 2 and therefore serves as an earthing means. Hence, no electrical charge is stored on the cooling container 2, preventing dust from adhering on the surface of cooling container 2.

Secondly, from the view point of the leakage or transfer of heat, providing the metallic connection by spring 8 between cooling container 2 and radiator 3 may be a question to be checked carefully.

However, the inventors of the present invention have confirmed that no substantial heat transfer is caused from radiator 3 (high-temperature side) to cooling container 2 (low-temperature side) when coil spring 8 has a sufficiently long winding length. This is believed that the long distance of coil spring 8 can prevent heat from transferring from radiator 3 to cooling container 2.

Finally, the control of the temperature of cooling container 2 will be explained hereinafter. Assuming that rotor 5 is maintained at 0° C., thermo-modules 7 are controlled to maintain the temperature of cooling container 2 at approximately −10° C. Radiation fins 3*a* of radiator 3 are forcibly cooled by fresh air supplied by a fan.

As apparent from the foregoing description, the present invention makes it possible to prevent the cooling container from being brought into contact with the heat-conductive grease applied on the thermo-module or the ball-piece in the mounting operation of the cooling container on the thermo-module or the ball-piece. Hence, it becomes possible to prevent the heat-conductive grease from undesirably spreading out of the contact surfaces in the sliding adjustment of the cooling container when the position of the cooling container is dislocated from the correct position, surely improving the heat transfer through the contact surface. The cooling apparatus, arranged as described above, is hence highly reliable.

As this invention may be embodied in several forms without departing from the spirit of essential characteristics thereof, the present embodiments described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A centrifugal separator comprising:

a rotor capable of accommodating a test sample therein;

a cooling container for accommodating said rotor therein;

at least one thermo-module interposed between said cooling container and a radiator, wherein said thermo-module is coupled to an upper surface of said radiator; and an elastic member means, interposed between said cooling container and said radiator such that said elastic member means contacts an upper surface of said radiator and a bottom surface of said cooling container, for providing a clearance between said cooling container and said thermo-module until the bottom surface of said cooling container is coupled with an upper surface of said thermo-module by a fastening mechanism.

2. The centrifugal separator in accordance with claim 1, wherein said elastic member means comprises a coil spring.

3. The centrifugal separator in accordance with claim 1, wherein said elastic member means comprises at least one of stainless steel and plastic.

4. A centrifugal separator comprising:

a rotor capable of accommodating a test sample therein;

a cooling container for accommodating said rotor therein;

at least one thermo-module interposed between said cooling container and a radiator, wherein said thermo-module is coupled to an upper surface of said radiator;

a ball-piece is provide on an upper surface of said thermo-module, said ball-piece is fixed to said radiator by means of a screw so as to sandwich said thermo-module between said radiator and said ball-piece; and at least one elastic member means, interposed between said cooling container and said radiator such that said elastic member means contacts an upper surface of said radiator and a bottom surface of said cooling container, for providing a clearance between said cooling container and said ball-piece until the bottom surface of said cooling container is coupled with an upper surface of said ball piece by a fastening mechanism.

5. The centrifugal separator in accordance with claim 4, wherein said elastic member means comprises a coil spring.

6. The centrifugal separator in accordance with claim 4, wherein said fastening mechanism comprises a screw and said cooling container and said ball-piece are fastened together by said screw so that said clearance is reduced.

* * * * *